United States Patent [19]

Spring

[11] Patent Number: 4,719,857

[45] Date of Patent: Jan. 19, 1988

[54] PYROTECHNIC DEVICE

[75] Inventor: David J. Spring, Slough, England

[73] Assignee: Pains-Wessex Limited, Salisbury, England

[21] Appl. No.: 376,386

[22] Filed: Mar. 29, 1982

[30] Foreign Application Priority Data

Apr. 1, 1981 [GB] United Kingdom ..... 8110182
Nov. 6, 1981 [GB] United Kingdom ..... 8133516

[51] Int. Cl.[4] ..... F42B 4/00

[52] U.S. Cl. ..... 102/335; 102/334; 102/356; 102/357; 102/505; 149/3; 149/6; 149/43; 149/72; 149/73; 149/87; 149/117

[58] Field of Search ..... 102/505, 335, 334, 356, 102/357; 149/116, 117, 3, 6, 43, 72, 73, 87

[56] References Cited

U.S. PATENT DOCUMENTS 2,072,719 3/1937 Pearsall ..... 149/72
3,770,525 11/1973 Villey-Desmeserets et al. ... 149/116
4,363,679 12/1982 Hagel et al. ..... 149/44 X
4,406,227 9/1983 Beeker et al. ..... 102/505

FOREIGN PATENT DOCUMENTS 2556256 6/1977 Fed. Rep. of Germany ..... 149/117

*Primary Examiner*—Stephen J. Lechert, Jr.
*Attorney, Agent, or Firm*—Larson and Taylor

[57] ABSTRACT

The pyrotechnic device comprises a projectile, a ground mounted device or a floating device whose casing contains a charge of particulate material, for example a combustible silicon-containing material in particular mixed with titanium or other suitable combustible metal-containing material and gunpowder such that, following ignition, infra-red emitting particles are emitted for forming an infra-red radiating screen.

6 Claims, 1 Drawing Figure

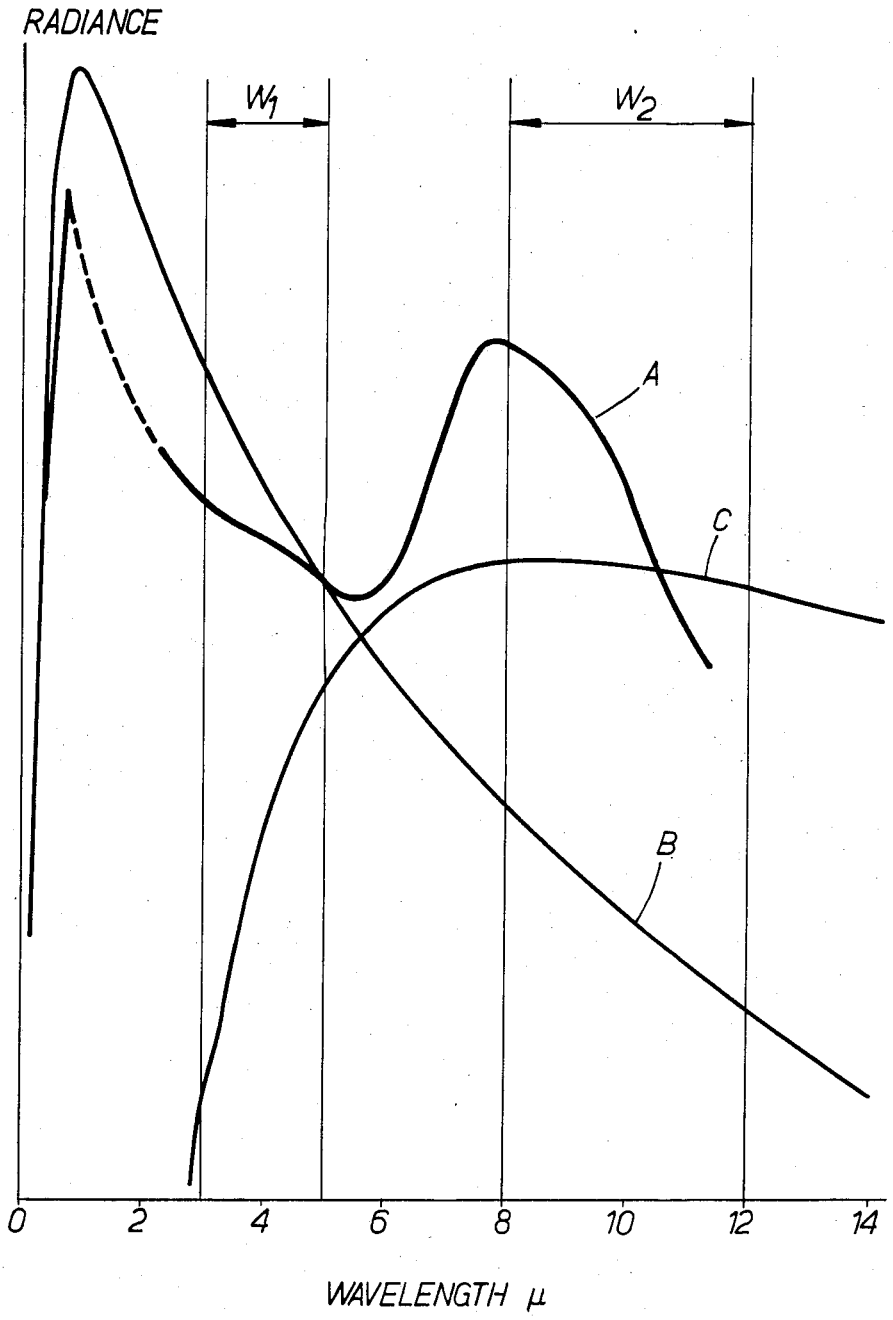
RADIANCE
W1
W2
A
C
B
0
2
4
6
8
10
12
14
WAVELENGTH μ

PYROTECHNIC DEVICE

BACKGROUND TO THE INVENTION

This invention relates to a pyrotechnic device, and more particularly to a device for use in screening a heat-emitting source from a heat-seeking or heat-detecting device, including for example a laser. Alternatively it can act as a decoy to such a device. The word 'heat' is used herein to signify electromagnetic radiation in the 3–14 micron waveband.

The invention finds application, in a military sense, in screening tanks, ships, or other heat-emitting vehicles or other sources of heat, including personnel, from heat-seeking missiles or infra-red detecting aiming systems, lasers and the like.

BRIEF SUMMARY OF THE INVENTION

In accordance with the invention, there is provided a pyrotechnic device for use in screening a heat-emitting source from a heat-seeking or heat-detecting device, the pyrotechnic device containing a pyrotechic composition which comprises a particulate substance, a combustible propellant capable, upon ignition, of heating the particulate substance and expelling it from the device to form a screen of hot particles having a substantial degree of radiation in the 3–14 micron wavelength band, by combustion or otherwise, and means for inhibiting oxidation of the particulate substance within the device.

In particular, the device is arranged to emit discrete burning particles over a relatively large volume. The nature of the particles is such that they emit electromagnetic radiation over a wide range of wavelengths, but principally in the infra-red region.

DETAILED DESCRIPTION

If a pyrotechnic device in accordance with the invention is ignited at a distance, for example of 20 meters, in front of a heat-emitting vehicle, or preferably a salvo of such devices, spaced apart for example at 3 meter intervals, is ignited in front of such a vehicle, a screen of infra-red emitting particles is set up in front of the vehicle, the screen being for example 5 meters high and 38 meters wide. This screen will be effective to reduce the infra-red emission contrast ration between the vehicle and its surroundings and so confuse the guidance system of a heat-seeking missile or confuse the heat-sensitive detecting device or thermal imaging equipment of an aiming device or the like. This effect is enhanced if the device pulses, and so continually changes the contrast ratio, which foils any attempt to reset detection equipment to counter the effect of the screen.

Pulsing can be produced by varying the composition within the device, or by incorporating ingredients for slowing down the rate of combustion, or by mechanical design of the nozzle through which the hot gases and particles are ejected, which results in pressure oscillation.

This screen will be effective for producing an average radiance (over its area) that is at least as large as that of the target to be screened, and may even be sufficiently large to saturate any detection equipment, and it will reduce the contrast ratio between the target and its surroundings. In this way the guidance system of a heat-seeking missile is confused and the target hidden from thermal imaging equipment or from a laser aiming device. This effect is also enhanced by the pulsation of the screen and the continual movement of the combusting particles which keep the contrast ratio continually changing.

In theory, any combustible material can be used as the heat-absorbing or heat-emitting substance, but in order to get practicable devices sizes and large screen areas with reasonable duration times it is important that the materials have large IR emissions in the wavelength bands of interest. Metals are favoured in this respect for the following reasons:

(i) they have high heats of combustion per gram of material, (ii) they have high combustion temperatures, (iii) the products of combustion are metal oxides which have emission bands in the required wavelengths, especially in the 8–14 micron range, (iv) the metal oxide combustion products are involatile and form a fine smoke which scatters and absorbs radiation from the target vehicles.

A number of metal powders can be used with these devices and these may be single elements, or alloys of two or more metals, or alloys of metals with semimetals and non-metals, or mixtures of two or more metals or alloys. Titanium is one such metal which has desirable combustion and IR emission characteristics. A typical temperature achieved by the combustion of titanium is 3000° K. and, as a result, hot titanium oxides, e.g. $TiO_2$, $Ti_3O_5$, $Ti_2O_3$, TiO etc., are formed which together emit strongly in the 8–12 micron band, The peak of this radiation lies in the 8–9 micron region, and the radiance then falls rapidly with increasing wavelength. However the mean radiance in the 8–12 micron band is about 20–30 times that predicted by black body radiation theory.

In the case of titanium, because the combustion temperature is below both the metal and metal oxide boiling points (3590° and 3500° K. respectively) and since the oxides are soluble in the molten metal, the metal particle combusts as a molten droplet with oxygen from the air migrating through the outer oxide layers to the metal. As a consequence, for much of the combustion, the molten droplet remains essentially constant in size, although towards the end explosive ejection of showers of small particles occurs (e.g. see A. F. Clarke, J. C. Moulder and C. C. Runyan, Combustion and Flame, 1974), 23, 129). Metals which exhibit similar combustion properties to Titanium are the other elements of Group IVA of the Periodic Table, Zr and Hf, the Group VA elements V, Nb, Ta, the lanthanides and actinides.

The spectral emission characteristics of metals and alloys will vary according to the elements concerned. Metals which exhibit spectral emission characteristics similar to that of titanium include Zr, Hf, Mn. Other elements exhibit a shallower decline in radiance than that of titanium with increasing wavelength in the 8–12 micron region, or indeed an emission peak at longer wavelengths, e.g., Si, V. Fe. Depending on the spectral emission characteristics desired a mixture of two or more metals may be preferred, e.g. mixtures of titanium and silicon result in a spectral radiance distribution in the 8–12 micron range that is relatively flat since the emission band centered on 10 microns due to combusting silicon combines with the above-mentioned titanium band to provide better coverage of emission in the 8–12 micron atmospheric window, (i.e, the range of radiation wavelengths which are not absorbed by the atmopshere). Alloys of metals, or of metals with semimetals or with non-metals, can be used; examples are TiC, $TiSi_2$, $TiB_2$, $NiAl_2$, $CaSi_2$, $Ni_2Zr_3$. Especially preferred in this group are the Ti-Si alloys. There may be advantages in using alloys rather than mixtures when one of the elements is difficult to ignite.

A suitable composition for the charge of the pyrotechnic device comprises

40% titanium powder,
15% carbon, e.g. in the form of charcoal, and
45% meal gunpowder, or the components of gunpowder.

A second suitable composition comprises

32% titanium powder,
16% charcoal,
47% meal gunpowder,
4% acaroid resin,
1% potassium nitrate.

In this second composition, the acaroid resin is included as a burning rate modifier and the potassium nitrate to improve the effect of the resin. This composition, although containing a lower percentage of titanium powder than the first composition, will have a longer burning time and can meet the requirements of a device capable of providing an effective screen over a period of 30 seconds.

Varying requirements of height of screen, duration of screen and density of screen are satisfied by varying the relative amounts of the components. An increase in the proportion of the particulate substance will provide an increase in the density and duration of the screen but will reduce the height of the screen if accompanied by a reduction in the proportion of propellant. On the other hand, an increase in the porportion, or gas-producing effect, of the propellant will increase the height of the screen at the cost of duration if the amount of particulate substance is reduced.

the duration of the screen will depend on the burning rate of the propellant, which can be reduced by additives as described herein, but at the cost of reducing the proportions of the particulate substance or the propellant.

Particle size of the metal fuel will be an important factor in formulating the best composition for the screen. Obviously, the smaller the particles, the larger the number per unit weight and the larger the emitting surface area of the particles per unit weight. However, combustion times will decrease with decreasing particle size. Smaller particles are more easily ejected from the device and will travel further before burn out; they are also more easily ignited, which not only affects performance of the device but also safety in the handling of screen materials. Accordingly, the range of particle sizes and the quantities of materials in each particle size will be selected in accordance with the size and intensity and duration of the required screen.

It will be apparent that the contents of titanium powder in the above-mentioned examples of suitable compositions is much higher than that normally used in fireworks, where the titanium content is typically 10% and rarely greater than 20%. Such firework type compositions also tend to be rich in potassium nitrate which is an oxygen rich substance.

In contrast, the preferred composition used in the present invention utilises charcoal to produce an oxygen deficiency in the combustion products leaving the device such that the amount of titanium consumed before being ejected is kept to a minimum. The excess carbon not only reacts with any oxygen inside the device in preference to titanium, but also the hot carbon oxides formed as a result of combustion, expand and assist the propellant in driving out the burning titanium powder. Hot carbon particles and carbon oxides discharged from the device also themselves emit electromagnetic radiation in the infra-red region.

As a consequence of this, the device is very efficient in terms of the weight of titanium which is ejected into and burnt in the atmosphere, and the low weight of charge remaining inside the device once combustion is complete. The device is thus far superior in its performance to a comparable firework composition.

As an alternative to charcoal, as means for producing an oxygen deficiency, other reducing agents could be used.

As an alternative to gunpowder, other propellants such for example as nitrocellulose could be used, with or without other gas-producing agents such for example as guanidine nitrate. Propellants with greater gas producing properties will increase the speed and distance of ejection and thereby reduce the need to create oxygen deficiency. If such other propellants produce an oxygen deficiency, the amount of charcoal in the mixture can be reduced.

Agents for aiding the combustion of the metal or alloy particles can be included, such for example as fluorinated organic polymers, in particular P.T.F.E.

Particles of the metal or alloy can be coated with agents for slowing down the combustion process, such for example as fluorinated organic polymers. Such coatings can render the metal or alloy particles easier and/or safer to handle.

The pyrotechnic device can be incorporated in a mortar-type projectile or rocket, or in a ground-supported device for use on land, or, in a floating device for use at sea. Alternatively, the pyrotechnic device could be incorporated in a shell designed to burst above the ground, or above water, or designed to drop slowly suspended from a parachute, for example, in the manner of a flare. Normally, a plurality of such devices suitable spaced apart, and possibly in repeated salvos, will be required to produce and maintain a suitable screen. For marine use, such a screen may need to be 100 meters high.

The single FIGURE of the accompanying drawings shows the relationship between the spectral radiance of a composition according to the invention (the composition referred to above as a second suitable composition) in curva A and a hypothetical particulate screen emitting merely black body radiation in curve B, the particles of the screen having a particle density in the air comparable with that of the composition according to the invention and being maintained at the same temperature.

The drawing illustrates the two atmospheric windows $W_1$ and $W_2$ for the transmission of infra-red radiation, namely in the 3–5 and 8–12 micron wavelength bands. The drawing also shows the black body radiation, curve C, of a typical target at 360° K. and further shows that although the hypothetical screen provides effective radiation in the lower wavelength atmospheric window $W_1$, the amount of radiation which it provides in the upper wavelength atmospheric window $W_2$, as described previously herein, is far below that needed for effective screening. Moreover the screening effect falls away quickly with increase of wavelength. The composition according to the invention, on the other hand, provides radiation substantially greater than that of the target over the 8–10 micron wavelength band.

The 8–10 micron wavelength band is the band in which heat-seeking and heat-detecting devices currently are most sensitive. If, however, such range of sensitivity were extended into the 10–14 micron wavelength band, the effective range of radiation of the composition can be extended, as described herein, by the inclusion of such substances as silicon.

The effect of adding to titanium other metals or metal alloys can be judged from the following table which gives the mean radiances in three wavelength bands of various substances measured in the laboratory during combustion of small (e.g. 3–5 gram) devices, as compared to titanium whose radiance in the 7.5–8.4 micron band has been arbitrarily assigned the value of 100, and the other values have been expressed relative to this.

RELATIVE RADIANCES IN WAVELENGTH BAND

| | WAVELENGTH BANDS | | |
|---|---|---|---|
| Material | 7.5–8.4 microns | 9.8–11.5 microns | 8.0–13.3 microns |
| | RADIANCE VALUES | | |
| TITANIUM | 100 | 10 | 10 |
| SILICON | 25 | 19 | 13 |
| TITANIUM SILICIDE | 34 | 24 | 19 |
| ZIRCONIUM | 72 | 10 | 15 |
| ZIRCONIUM SILICIDE | 54 | 33 | 24 |
| ALUMINIUM SILICIDE | 37 | 30 | 19 |

The results show the effect of silicon (either alone or as an alloy) in increasing the infra-red radiation around 10 microns relative to that around 8 microns, which may be desirable in some applications.

With this ability to tailor the spectral distribution of the radiation emitted by the screen, it will be apparent that it is possible to arrange that the spectral distribution of radiation should change during the course of the device operation by having zones of different pyrotechnic composition in the device, e.g. one based on titanium alternating with one based on silicon. This could hinder any attempt to defeat the screen by resetting the thermal imager etc., in the same way as pulsation of the screen described earlier.

I claim:

1. A pyrotechnic device for use in screening a heat-emitting source from a heat-seeking or heat-detecting device, the pyrotechnic device containing a pyrotechnic composition which consists essentially of a combustible particulate substance, and a combustible propellant for, upon ignition, heating the particular substance and expelling the particulate substance from the device to form a screen of hot particles having a substantial degree of radiation in the 3–14 micron wavelength band, wherein the particulate substance is selected from the group which consists of silicon, silicon alloys and silicon compounds.

2. A pyrotechnic device for use in screening a heat-emitting source from a heat-seeking or heat-detecting device, the pyrotechnic device containing a pyrotechnic composition which consists essentially of a combustible particulate substance, a combustible propellant for, upon ignition, heating the particulate substance and expelling the particulate substance from the device to form a screen of hot particles having a substantial degree of radiation in the 3–14 micron wavelength band, wherein the particulate substance is a mixture of an ingredient selected from the group which consists of titanium, titanium alloys, and titanium compounds and an ingredient selected from the group which consists of silicon, silicon alloys and silicon compounds.

3. A pyrotechnic device according to claim 1 wherein the particulate substance is titanium silicide.

4. A pyrotechnic device for use in screening a heat-emitting source from a heat-seeking or heat-detecting device, the pyrotechnic device containing a pyrotechnic composition which consists essentially of a combustible particulate substance, and a combustible propellant for, upon ignition, heating the particulate substance and expelling the particulate substance from the device to form a screen of hot particles having a substantial degree of radiation in the 3–14 micron wavelength band, wherein the particulate substance is selected from the group which consists of zirconium, hafnium, manganese, vanadium, iron and alloys and compounds of the aforesaid metals.

5. A pyrotechnic device according to claim 1, wherein said composition contains a substance selected from the group which comprises P.T.F.E., or other fluorinated organic polymers and other substances effective to aid combustion of the particulate substance.

6. A pyrotechnic device according to claim 1 wherein the composition is effective to cause pulsation of the spectral distribution of the radiation in the said band.

* * * * *